US008319808B2

(12) United States Patent
Sadowara et al.

(10) Patent No.: US 8,319,808 B2
(45) Date of Patent: Nov. 27, 2012

(54) IMAGE FORMING APPARATUS

(75) Inventors: Tetsuya Sadowara, Shizuoka-ken (JP); Eiichi Yamanishi, Kanagawa-ken (JP); Hiroyuki Okuyama, Kanagawa-ken (JP); Yoshihito Hiroe, Shizuoka-ken (JP); Hiromasa Tanaka, Shizuoka-ken (JP); Yasuaki Okamoto, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 12 days.

(21) Appl. No.: 13/112,080

(22) Filed: May 20, 2011

(65) Prior Publication Data

US 2011/0292153 A1 Dec. 1, 2011

Related U.S. Application Data

(60) Provisional application No. 61/347,993, filed on May 25, 2010.

(51) Int. Cl.
*B41J 29/16* (2006.01)

(52) U.S. Cl. ..... 347/179

(58) Field of Classification Search ..... 347/171, 347/179, 223, 104, 105; 400/120.01, 198
See application file for complete search history.

(56) References Cited

U.S. PATENT DOCUMENTS

| | | | | |
|---|---|---|---|---|
| 5,274,460 | A * | 12/1993 | Yamada et al. | 347/179 |
| 5,436,643 | A * | 7/1995 | Yamaguchi et al. | 347/179 |
| 5,453,765 | A * | 9/1995 | Yamaguchi et al. | 347/179 |
| 7,184,069 | B2 * | 2/2007 | Yamamoto et al. | 347/179 |
| 7,203,436 | B2 | 4/2007 | Imamiya | |

* cited by examiner

*Primary Examiner* — Kristal Feggins
(74) *Attorney, Agent, or Firm* — Turocy & Watson, LLP

(57) ABSTRACT

According to one embodiment, there is provided an image forming apparatus, including an accommodation unit, an image forming unit, an image reading unit, an image erasing unit, a first medium processing unit, and a second medium processing unit. The first medium processing unit forms the image on the recording medium carried from the accommodation unit and discharges the recording medium on which the image is formed, based on the setting of a first image process mode. The second medium processing unit forms a test image on the recording medium carried from the accommodation unit, reads the test image, erases the test image, and returns the recording medium to the accommodation unit, based on a setting of a second image process mode.

20 Claims, 7 Drawing Sheets

IMAGE FORMING APPARATUS

CROSS-REFERENCE TO RELATED APPLICATIONS

This application is based upon and claims the benefit of priority from U.S. Provisional Application No. 61/347,993, filed on May 25, 2010; the entire contents of which are incorporated herein by reference.

FIELD

Embodiments described herein relate generally to an image forming apparatus.

BACKGROUND

A person responsible wishing to adjust image quality of an image forming apparatus inputs a printing command for a correction pattern to the image forming apparatus. In response thereto, the image forming apparatus prints the correction pattern on paper. The person responsible sets the paper on which the correction pattern is printed and inputs an image reading command to the image forming apparatus. In response thereto, the image forming apparatus reads the correction pattern from the paper and adjusts various parameters based on the results read. As a result, the image forming apparatus adjusts, for example, tone reproduction, or the like.

DETAILED DESCRIPTION

In general, according to one embodiment, an image forming apparatus includes an accommodation unit, an image forming unit, an image reading unit, an image erasing unit, a first medium processing unit, and a second medium processing unit. The accommodation unit accommodates a recording medium. The image forming unit forms an image on the recording medium. The image reading unit reads the image from the recording medium on which the image is formed. The image erasing unit erases the image from the recording medium on which the image is formed. The first medium processing unit forms the image on the recording medium carried from the accommodation unit and discharges the recording medium on which the image is formed, based on the setting of a first image process mode. The second medium processing unit forms a test image on the recording medium carried from the accommodation unit, reads the test image, erases the test image, and returns the recording medium to the accommodation unit, based on the setting of a second image process mode.

First Embodiment

Figure 1:
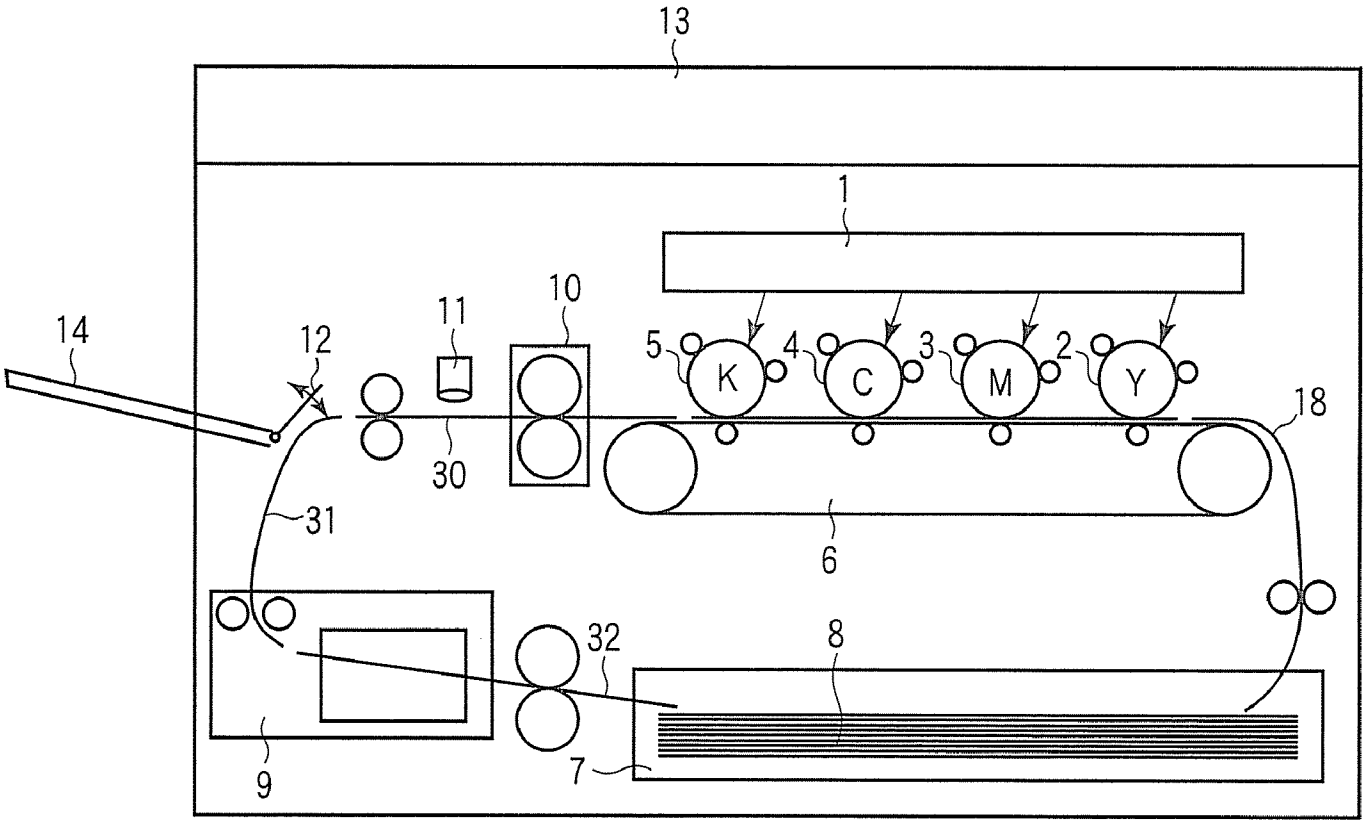
FIG. 1 is a cross-sectional view showing an example of an image forming apparatus according to a first embodiment.
Figure 7:
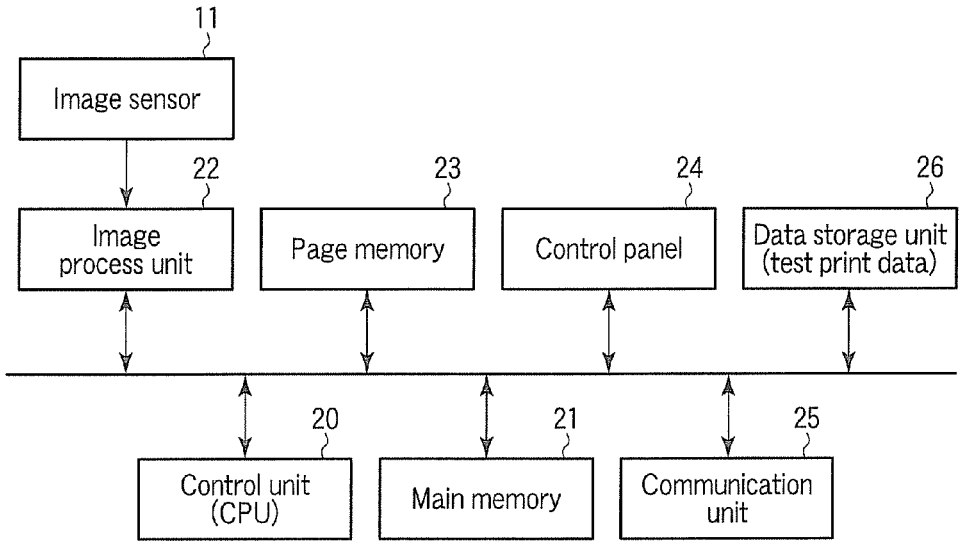
FIG. 7 is a block diagram showing an example of an image forming apparatus according to first, second, and third embodiments.

FIG. 1 shows a cross-sectional view of an example of an image forming apparatus according to a first embodiment. FIG. 7 shows a block diagram of an example of the image forming apparatus according to the first embodiment.

As shown in FIG. 1, the image forming apparatus includes a laser emitting unit 1, a Y-color photoconductor 2, an M-color photoconductor 3, a C-color photoconductor 4, a K-color photoconductor 5, a transfer belt 6, a paper-feeding cassette 7, a recording material eraser 9, a fixing unit 10, an image sensor 11, a paper discharging destination switching unit 12, a scanner unit 13, and a paper discharging tray 14. Further, as shown in FIG. 7, the image forming apparatus includes a control unit (CPU) 20, a main memory 21, an image process unit 22, a page memory 23, a control panel 24, a communication unit 25, and a data storage unit 26.

Further, in order to elucidate and facilitate the description of the embodiments, the laser emitting unit 1, the Y-color photoconductor 2, the M-color photoconductor 3, the C-color photoconductor 4, the K-color photoconductor 5, the transfer belt 6, the fixing unit 10, and the image process unit 22, or the like, are collectively referred to as an image forming unit. Further, the Y-color photoconductor 2, the M-color photoconductor 3, the C-color photoconductor 4, the K-color photoconductor 5 are collectively referred to as a photoconductor.

Further, the image forming apparatus shown in FIG. 1 carries paper (recording medium) 8 through a first route. That is, the image forming apparatus takes out the paper 8 accommodated in the paper-feeding cassette 7 to carry the taken-out paper 18 to the photoconductor, the fixing unit 10, and the image sensor 11 and carry the taken-out paper 18 to the paper discharging tray (discharging destination) 14 via the paper discharging destination switching unit 12.

Alternatively, the image forming apparatus carries the paper 8 through a second route. That is, the image forming apparatus takes out the paper 8 accommodated in the paper-feeding cassette 7 to carry the taken-out paper 18 to the photoconductor, the fixing unit 10, and the image sensor 11, carry paper 31 to the recording material eraser 9, and return the taken-out paper 18 to the paper-feeding cassette 7 again.

The control unit 20 of the image forming apparatus sets a general print mode (first image process mode) in response to the designation of a general printing through the control panel 24 to control the execution of paper carriage via the first route, control the operation of the image forming unit, and execute the general print processing (first image forming process). That is, the scanner unit 13 of the image forming apparatus reads the image from a document, and the image forming unit forms the image on the paper 18 based on the read image data (image data designated by a user) and carries paper 30 on which the image is formed to the paper discharging tray (discharge destination) 14 via the paper discharging destination switching unit 12.

Alternatively, the control unit 20 of the image forming apparatus sets the general print mode (first image process mode) in response to the reception of the print data (image data designated by a user) via the communication unit 25 to control the execution of the paper carriage via the first route, control the operation of the image forming unit, and execute the general print processing (first image forming process). That is, the communication unit 25 of the image forming apparatus receives the print data, the image forming unit forms the image on the paper 18 based on the print data and carries the paper 30 on which the image is formed to the paper discharging tray (discharge destination) 14 via the paper discharging destination switching unit 12.

Alternatively, the control unit 20 of the image forming apparatus sets an image-quality adjustment print mode (second image process mode) in response to the execution command of the image-quality adjustment mode to control the execution of the paper carriage via the second route, controls the operation of the image forming unit, and executes the image-quality adjustment print processing (second image forming process). That is, the image forming unit of the image forming apparatus forms the test image on the paper 18 based on the test print data (image data for test) stored in the data storage unit 26, the image sensor 11 reads the test image from the paper 30 and carries the paper 30 on which the image is formed to the recording material eraser 9 via the paper discharging destination switching unit 12, and the recording material eraser 9 erases the test image from paper 31 and carries paper 32 from which the image is erased to the paper-feeding cassette 7 as re-accommodation destination.

Hereinafter, the general print mode (first image process mode) and the image-quality adjustment print mode (second image process mode) will be described in detail.

The image forming apparatus forms the image on the paper 18 using the erasable recording material. For example, the recording material eraser 9 heats the paper 31 on which the image is formed at an erasing temperature. Thereby, the recording material (image) recorded on the paper 31 may not visible to the eye (erased). The paper 32 from which the image is erased may be used again. That is, the image may again be formed on the paper 32 from which the image is erased.

As described above, the image forming apparatus includes the image sensor 11 disposed under the fixing unit 10, the paper discharging destination switching unit 12, and the mechanism carrying the paper 32 to the paper-feeding cassette 7 from the recording material eraser 9. Thereby, the image forming apparatus may read the image from the paper 8 on which the test image is recorded by the image sensor 11 in response to the setting of the image-quality adjustment print mode, carry the paper 30 on which the test image is recorded to the recording material eraser 9 by the paper discharging destination switching unit 12, erase the image on the paper 31 by the recording material eraser 9, and re-insert the paper 32 from which the image is erased into the paper-feeding cassette 7.

Figure 2:
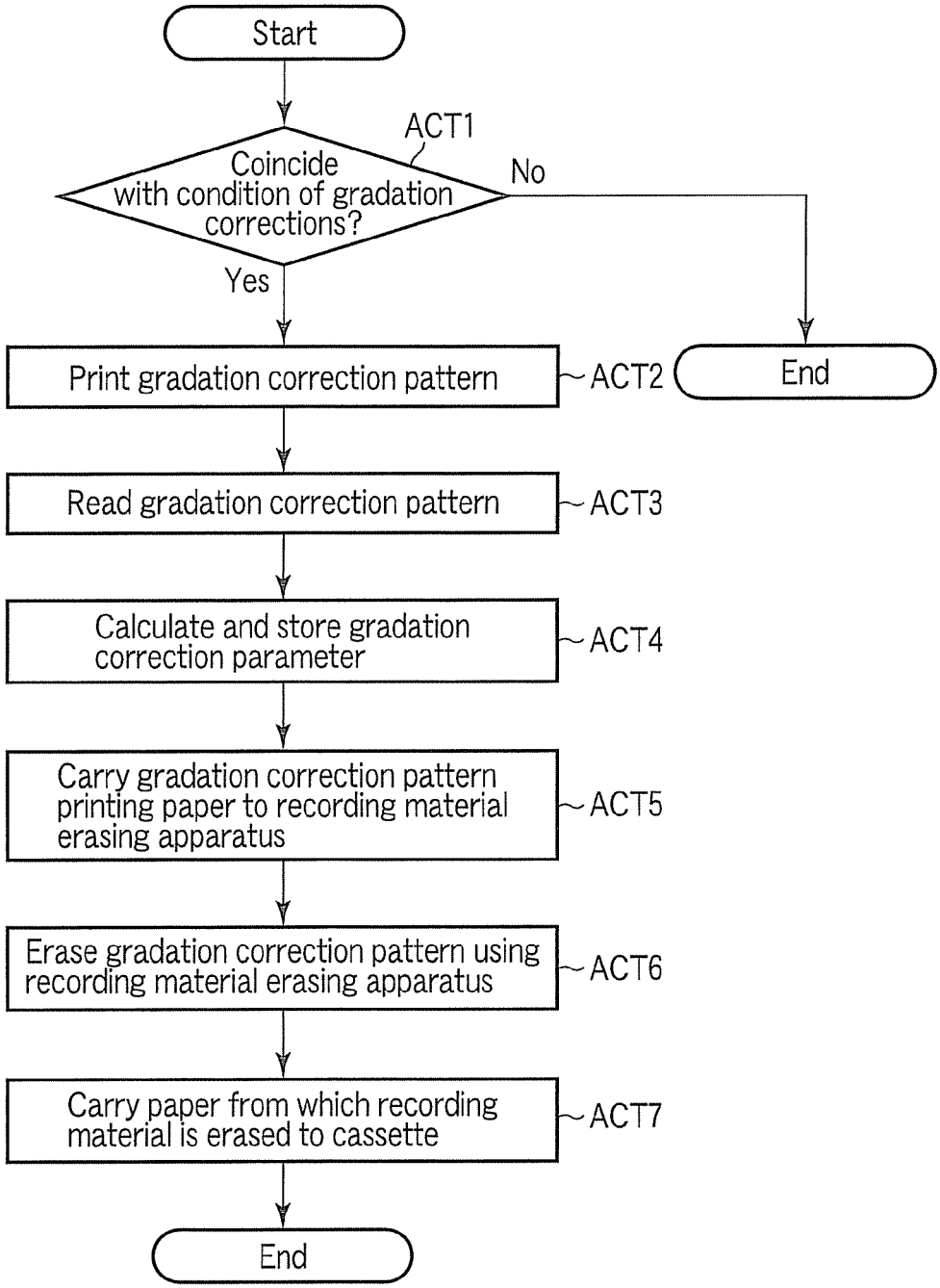
FIG. 2 is a flow chart showing an example of gradation correction.

Next, an example of the image-quality adjustment will be described with reference to FIG. 2. FIG. 2 shows a flow chart of an example of the gradation correction.

The data storage unit 26 of the image forming apparatus stores the execution conditions of the image-quality adjustment mode (for example, a gradation adjustment mode) and the control unit 20 commands the execution of the image-quality adjustment mode based on the execution conditions of the image-quality adjustment mode (ACT1, YES). For example, the control unit 20 commands the execution of the image-quality adjustment mode as described below.

(1) The control unit 20 commands the execution of the image-quality adjustment mode based on a power supply start (power on) to the image forming apparatus.

(2) The control unit 20 commands the execution of the image-quality adjustment mode based on integrated printing sheets. For example, when the integrated printing sheets reach a predetermined sheet, the control unit 20 commands the execution of the image-quality adjustment mode.

(3) The control unit 20 commands the execution of the image-quality adjustment mode based on the temperature. For example, when the temperature is changed to be greater than a predetermined temperature from a reference temperature value, the control unit 20 commands the execution of the image-quality adjustment mode.

(4) The control unit 20 commands the execution of the image-quality adjustment mode based on the humidity. For example, when humidity is changed to equal to or more than the predetermined humidity from the reference humidity value, the control unit 20 commands the execution of the image-quality adjustment mode.

(5) The control unit 20 commands the execution of the image-quality adjustment mode based on the toner exchange of the image forming apparatus.

Figure 3:
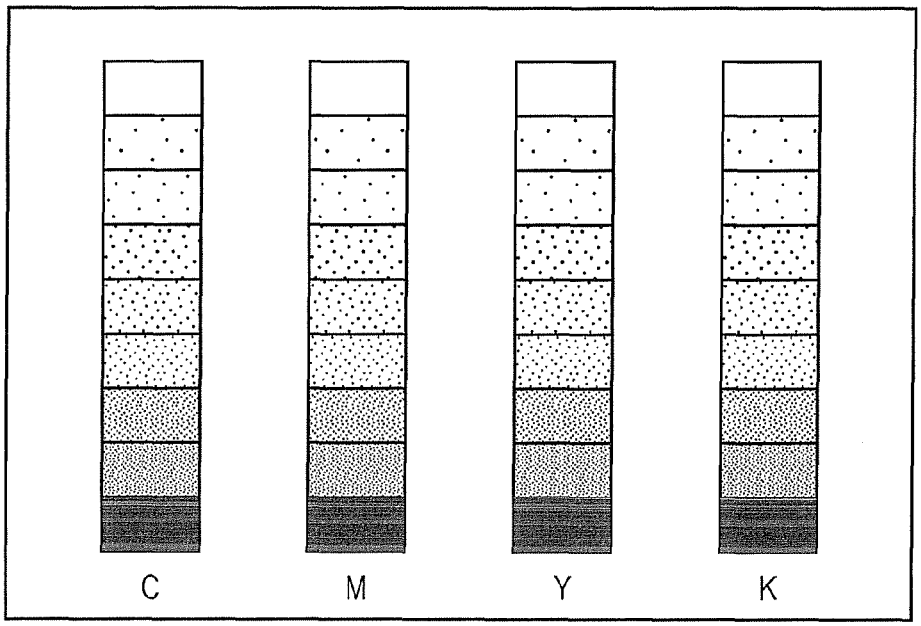
FIG. 3 is a diagram showing a first example of a test pattern.

When the control unit 20 of the image forming apparatus commands the execution of the image-quality adjustment mode, the image forming unit prints the pattern for gradation correction (test pattern) on the paper 8 as shown in FIG. 3 (ACT 2). Further, the image sensor 11 reads the pattern for gradation correction printed on the paper 30 (ACT 3).

Figure 4:
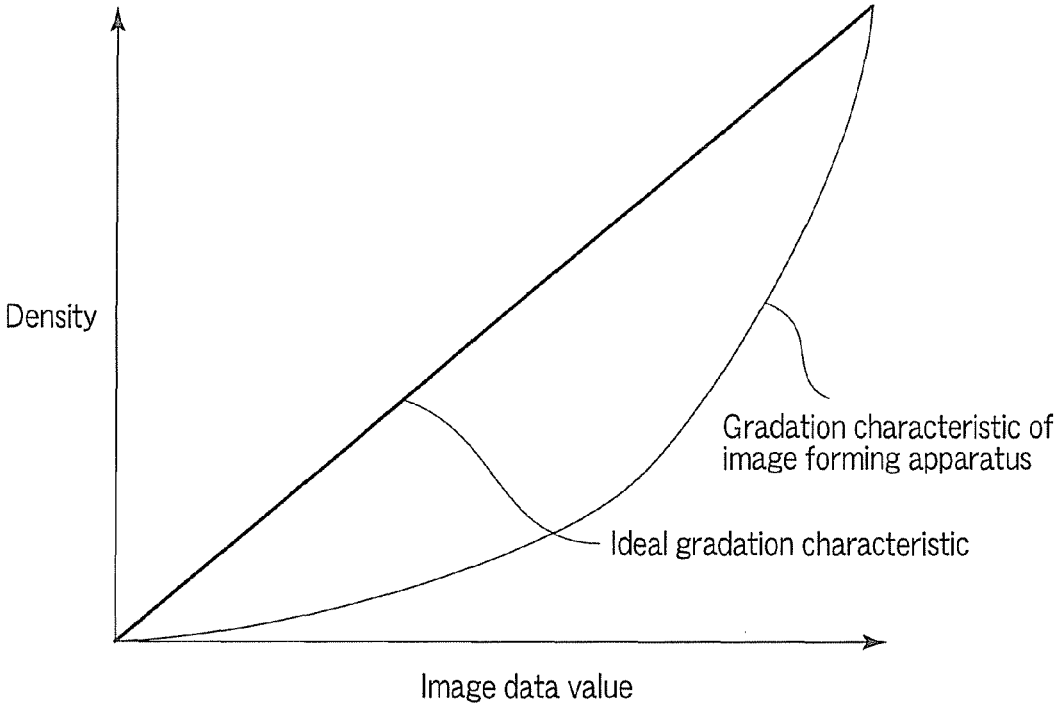
FIG. 4 is a diagram showing an example of specific gradation obtained from measurement.
Figure 5:
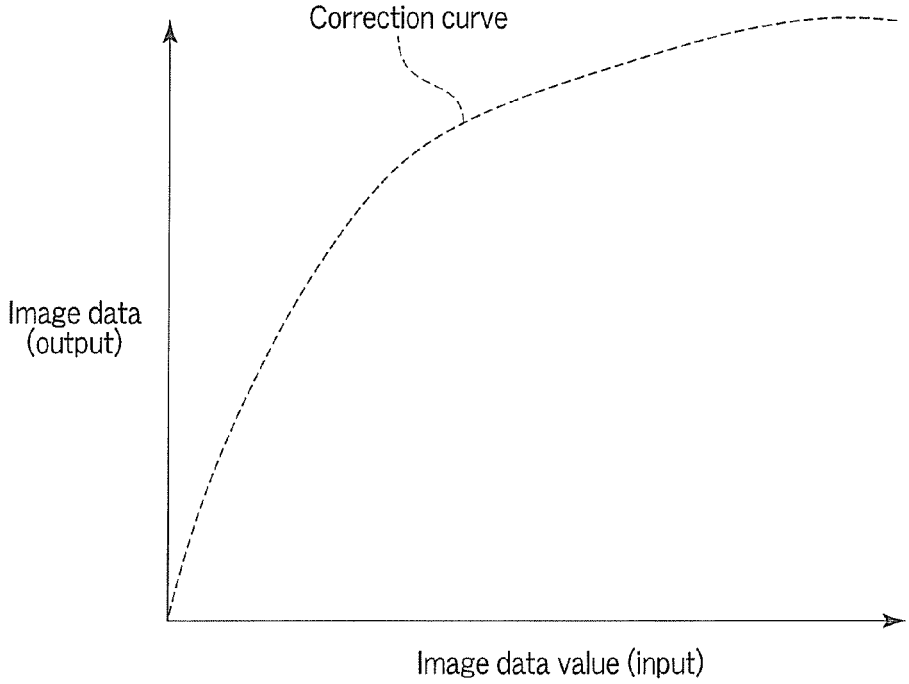
FIG. 5 is a diagram showing an example of a correction curve for converting the gradation characteristics obtained from the measurement into ideal gradation characteristics.

The image process unit 22 measures the reading results (gradation characteristics) as shown in FIG. 4 from the reading image data of the pattern for gradation correction. Further, the control unit 20 calculates a correction curve (FIG. 5) for converting the reading results (gradation characteristics) into ideal gradation characteristics. That is, the control unit 20 calculates the parameter for gradation correction for converting the results read (gradation characteristics) into the ideal gradation characteristics (ACT 4), stores the parameter for gradation correction in the data storage unit 26 (ACT 4), and sets the parameter for gradation correction to the image process unit 22. Thereby, the image process unit 22 may execute the gradation correction processing for forming the image of the ideal gradation characteristics based on the parameter.

The paper 30 on which the pattern for gradation correction is recorded is carried to the recording material eraser 9 via the paper discharging destination switching unit 12 (ACT 5), the recording material eraser 9 erases the pattern for gradation correction from the paper 31 (ACT 6), and the paper 32 from which the image is erased is carried to the paper-feeding cassette 7 as the re-accommodation destination (ACT 7).

Further, when the paper 32 to which the erasing process is applied by the recording material eraser 9 may be immediately reused, the paper is taken-out from the paper-feeding cassette 7 at the time of the subsequent printing and is carried. For example, when there is a need to cool the paper 32 heated by the erasing process, the control unit 20 performs a control to stop the use of the paper-feeding cassette 7 for a predetermined period.

Thereby, the image forming apparatus may automatically perform the image correction processing (gradation correction processing) with high accuracy at an appropriate timing, without the user performing the printing command of the correction pattern and the working for the scanner operation. In addition, since the image forming apparatus may automatically return the paper used to print the test pattern to the paper-feeding cassette 7, the waste of paper may be prevented.

Figure 6:
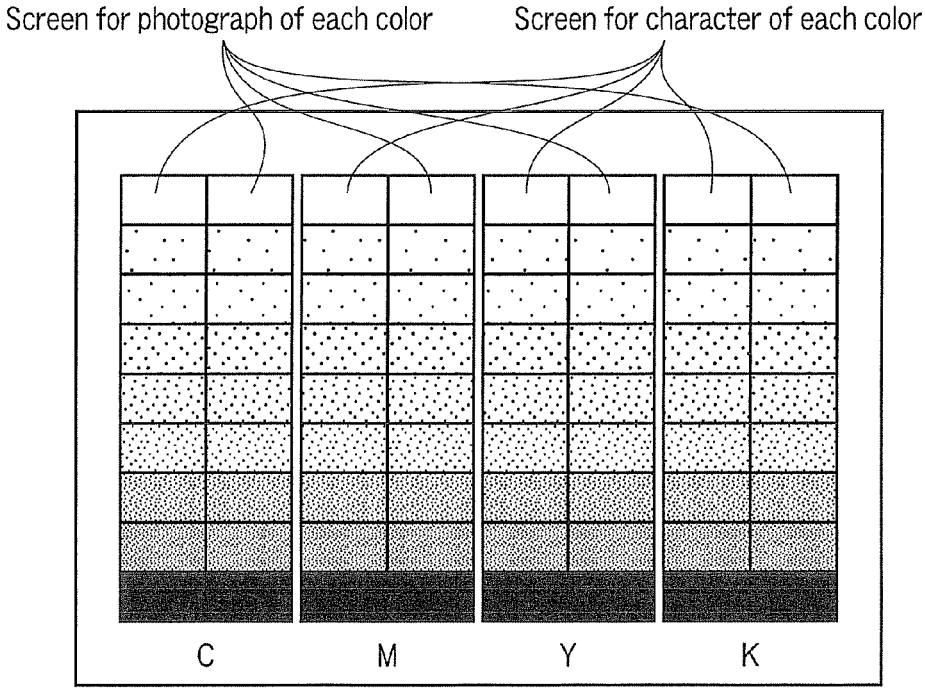
FIG. 6 is a diagram showing a second example of a test pattern.

In addition, the case where the image forming apparatus prints one type of screen (FIG. 3) for each of the CMYK colors on a sheet of paper and executes the gradation correction processing based on the printing results is described above. Further, the image forming apparatus may print at least two kinds of screens for each of the CMYK colors and execute the gradation correction processing based on the printing results. For example, as shown in FIG. 6, the image forming apparatus may print a screen for characters and a screen for photographs for each of the CMYK colors on a sheet of paper and execute the gradation correction processing for characters and photographs based on the printing results. Alternatively, the image forming apparatus may print the screen for characters for each of the CMYK colors on a sheet of paper, print the screen for photographs for each of the CMYK colors on two sheets of paper, and execute the gradation correction processing for characters and photographs based on the printing results of a first sheet and a second sheet.

Further, even in a single color image forming apparatus, rather than the CMYK full color, the automatic image-quality adjustment processing may be executed, similar to the above description.

Figure 8:
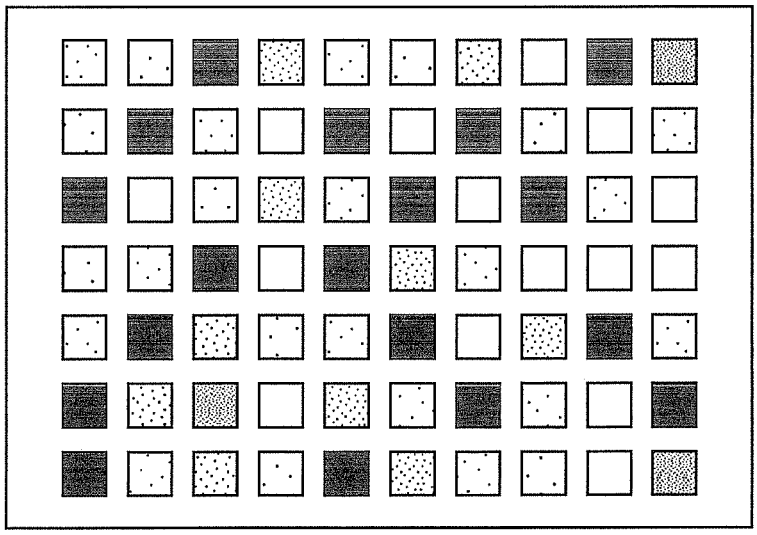
FIG. 8 is a diagram showing a third example of a test pattern.

Further, the case where the image forming apparatus executes the test printing of a single color patch of the CMYK as shown in FIGS. 3 and 6 and corrects the gradation characteristics of each of the CMYK colors is described above. Further, the image forming apparatus may execute the test printing of the patch including a secondary color, or the like, such as an RGB color as shown in FIG. 8, read each color by the image sensor 11, measure the gradation characteristics from the read image data by the image process unit 22, calculate the parameter for correction for color conversion in response to the gradation characteristics measured by the control unit 20, and set the parameter for correction (parameter for color conversion correction) for a color conversion unit of the image process unit. Thereby, the optimal color conversion meeting the state of the image forming apparatus may be made and the reproducibility for the CMYK single color and the secondary color such as the RGB, or the like or a color (including gray) represented by the overlapping of the CMYK may be improved. Even in the case, as described above, the image forming apparatus may execute the test printing of the patch including the secondary color, or the like, such as the RGB color as shown in FIG. 8 at an appropriate timing, and automatically calculate and set the parameter for correction. In addition, since the image forming apparatus may automatically return the paper used to print the test pattern to the paper-feeding cassette 7, the waste of paper may be prevented.

Second Embodiment

A second embodiment will be described based on components different from the first embodiment.

Figure 9:
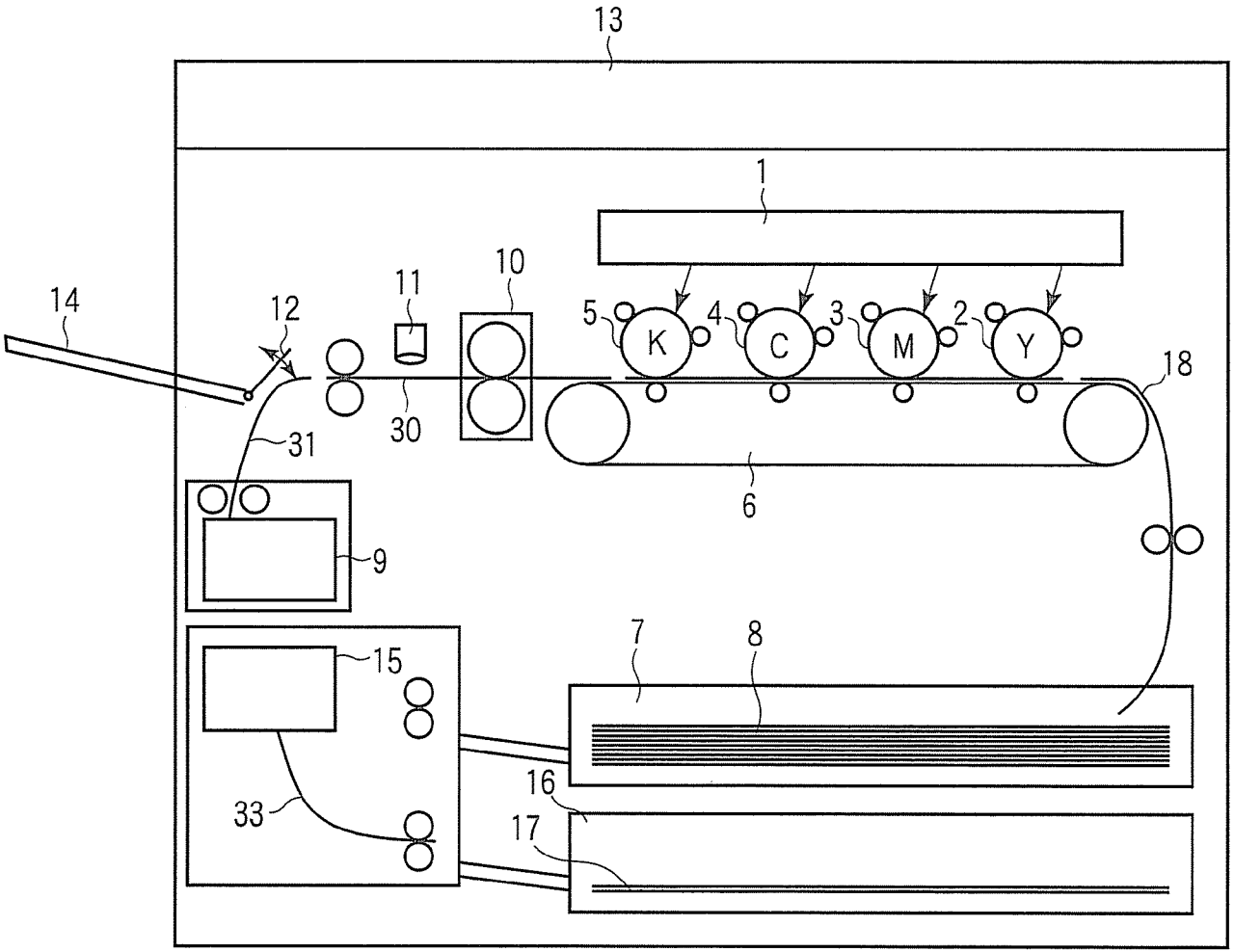
FIG. 9 is a cross-sectional view showing an example of an image forming apparatus according to the second embodiment.

FIG. 9 shows a cross-sectional view of an example of an image forming apparatus according to the second embodiment. FIG. 7 shows a block diagram of an example of the image forming apparatus according to the second embodiment.

As shown in FIG. 9, the image forming apparatus includes the laser emitting unit 1, the Y-color photoconductor 2, the M-color photoconductor 3, the C-color photoconductor 4, the K-color photoconductor 5, the transfer belt 6, the paper-feeding cassette 7, the recording material eraser 9, the fixing unit 10, the image sensor 11, the paper discharging destination switching unit 12, the scanner unit 13, the paper discharging tray 14, a sorter 15, and a waste paper tray 16.

Further, the image forming apparatus carries paper (recording medium) 8 through a first route. That is, the image forming apparatus takes out the paper 8 accommodated in the paper-feeding cassette 7 to carry the taken-out paper 18 to the photoconductor, the fixing unit 10, and the image sensor 11 and carry the taken-out paper 18 to the paper discharging tray (discharging destination) 14 via the paper discharging destination switching unit 12.

Alternatively, the image forming apparatus carries the paper through a second route. That is, the image forming apparatus takes out the paper 8 accommodated in the paper-feeding cassette 7 to carry the taken-out paper 18 to the photoconductor, the fixing unit 10, and the image sensor 11, carry the paper 30 to the recording material eraser 9, and return the paper to the paper-feeding cassette 7 again.

Alternatively, the image forming apparatus carries the paper 8 through a third route. That is, the image forming apparatus takes out the paper 8 accommodated in the paper-feeding cassette 7 to carry the taken-out paper 18 to the photoconductor, the fixing unit 10, and the image sensor 11, carry the paper 30 to the recording material eraser 9, and return the paper determined to be reusable to the paper-feeding cassette 7 via the sorter 15, and carries a waste paper 33 determined not to be reusable to the waste paper tray 16.

The control unit 20 of the image forming apparatus sets a general print mode (first image process mode) in response to the general designation of print through the control panel 24 to control the operation of the image forming unit using the paper carriage via the first route and executes the general print processing (first image forming process). That is, the scanner unit 13 of the image forming apparatus reads the image from a document and the image forming unit forms the image on the paper 8 based on the read image data and carries the paper 30 on which the image is formed to the paper discharging tray (discharge destination) 14 via the paper discharging destination switching unit 12.

Alternatively, the control unit 20 of the image forming apparatus sets the general print mode (first image process mode) in response to the reception of the print data via the communication unit 25 to control the operation of the image forming unit using the paper carriage via the first route and execute the general print processing (first image forming process). That is, the communication unit 25 of the image forming apparatus receives the print data and the image forming unit forms the image on the paper 8 based on the print data and carries the paper 30 on which the image is formed to the paper discharging tray (discharge destination) 14 via the paper discharging destination switching unit 12.

Alternatively, the control unit 20 of the image forming apparatus sets an image-quality adjustment print mode (second image process mode) in response to the execution command of the image-quality adjustment mode to control the operation of the image forming unit using the paper carriage via the second route and execute the image-quality adjustment print processing (second image forming process). That is, the image forming unit of the image forming apparatus forms the test image on the paper 8 based on the test print data stored in the data storage unit 26 and the image sensor 11 reads the test image from the paper 30, carries the paper 30 on which the image is formed to the recording material eraser 9 via the paper discharging destination switching unit 12, and carries the paper from which the image is erased to the paper-feeding cassette 7 as the re-accommodation destination when the sorter 15 determines that the paper from which the test image is erased by the recording material eraser 9 may be reused.

Alternatively, the control unit 20 of the image forming apparatus sets an image-quality adjustment print mode (second image process mode) in response to the execution command of the image-quality adjustment mode to control the operation of the image forming unit using the paper carriage via the third route, and execute the image-quality adjustment print processing (second image forming process). That is, the image forming unit of the image forming apparatus forms the test image on the paper 18 based on the test print data stored in the data storage unit 26 and the image sensor 11 reads the test image from the paper 30, carries the paper 30 on which the image is formed to the recording material eraser 9 via the paper discharging destination switching unit 12, and carries the paper 33 (waste paper 17) to the waste paper tray 16 when the sorter 15 determines that the paper from which the test image is erased by the recording material eraser 9 may not be reused.

The recording material eraser 9 erases the correction pattern from the paper 30 and 31 on which the correction pattern is printed as shown in FIG. 3 or 6, but when the recording material eraser 9 repeats the printing and the erasing several times, the recording material that is not erased remains on the paper and the paper is damaged. The sorter 15 determines whether the paper 8 is reusable based on the read results of the image sensor (not shown) disposed therein. The sorter 15 sorts the paper that may not be reused to the waste paper tray 16 by sorting whether the paper from which the correction pattern is erased is reusable based on the determination that the paper is not reusable, such that the waste paper tray 16 accommodates the pager 33 (waste paper 17). Thereby, in the paper from which the correction pattern is erased, the paper 33 that is not suitable for reuse is not used in the general print mode. As a result, the high-quality printing results may be output.

Third Embodiment

A third embodiment will be described based on components different from the first and second embodiments.

Figure 10:
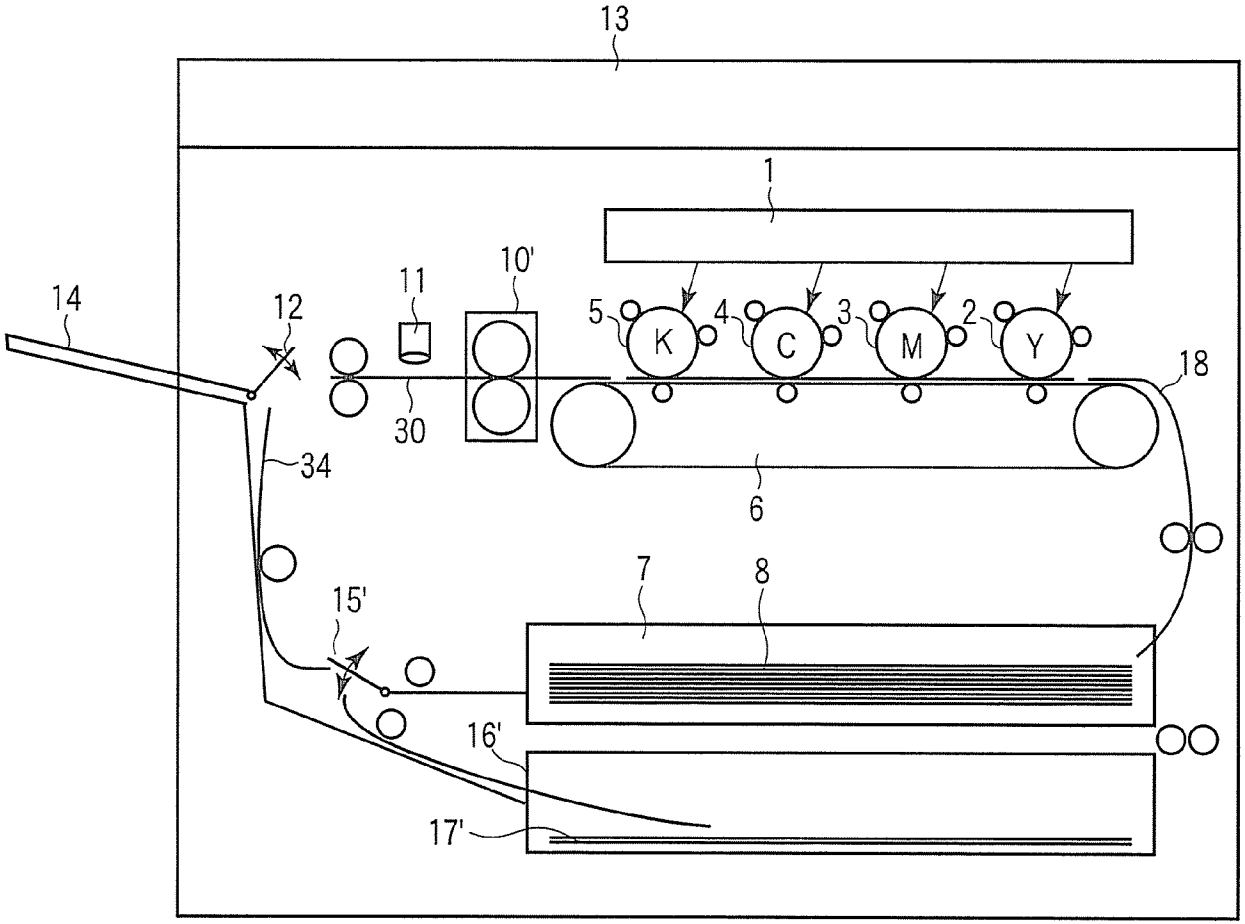
FIG. 10 is a cross-sectional view showing an example of an image forming apparatus according to the third embodiment.

FIG. 10 shows a cross-sectional view of an example of an image forming apparatus according to the third embodiment. FIG. 7 shows a block diagram of an example of the image forming apparatus according to the third embodiment.

As shown in FIG. 10, the image forming apparatus includes the laser emitting unit 1, the Y-color photoconductor 2, the M-color photoconductor 3, the C-color photoconductor 4, the K-color photoconductor 5, the transfer belt 6, the paper-feeding cassette 7, the recording material eraser 9, a fixing unit 10', the image sensor 11, the paper discharging destination switching unit 12, the scanner unit 13, the paper discharging tray 14, a carriage destination cassette switching unit 15', and a pre-erasing paper cassette 16'.

The fixing unit 10' heats the paper 30 at a first temperature and fixes the image recorded on the paper 33. Alternatively, the fixing unit 10' heats the paper 33 at a second temperature higher than the first temperature and erases the image recorded. That is, the fixing unit 10' serves as the fixing unit or the recording material eraser in response to the heating temperature.

The image forming apparatus according to the first and second embodiments includes the fixing unit 10 and the recording material eraser 9, but the image forming apparatus according to the third embodiment includes the fixing unit 10'. The fixing unit 10' serves as the fixing unit 10 and the recording material eraser 9.

Further, the image forming apparatus carries paper (recording medium) 8 through a first route. That is, the image forming apparatus takes out the paper 8 accommodated in the paper-feeding cassette 7 to carry the taken-out paper 18 to the photoconductor, the fixing unit 10' and the image sensor 11 and carry the taken-out paper 18 to the paper discharging tray (discharging destination) 14 via the paper discharging destination switching unit 12.

Alternatively, the image forming apparatus carries the paper 8 through a second route. That is, the image forming apparatus takes out the paper 8 accommodated in the paper-feeding cassette 7 to carry the taken-out paper 18 to the photoconductor, the fixing unit 10' and the image sensor 11 and further carry the paper 30 to the pre-erasing paper cassette 16' via the paper discharging destination switching unit 12 and the carriage destination cassette switching unit 15'.

Alternatively, the image forming apparatus carries the paper 8 through a third route. That is, the image forming apparatus takes out pre-erasing paper 17' accommodated in the pre-erasing paper cassette 16' and carries the taken-out paper 18 to the photoconductor, the fixing unit 10' and the image sensor 11, and further returns the paper 30 to the paper-feeding cassette 7 via the paper discharging destination switching unit 12 and the carriage destination cassette switching unit 15'.

The control unit 20 of the image forming apparatus sets a general print mode (first image process mode) in response to the general designation of print through the control panel 24 to control the execution of paper carriage via the first route, control the operation of the image forming unit, and execute the general print processing (first image forming process). That is, the scanner unit 13 of the image forming apparatus reads the image from a document, the image forming unit forms the image on the paper 8 based on the read image data, and the carriage mechanism 18 carries the paper 8 on which the image is formed to the paper discharging tray (discharge destination) 14 via the paper discharging destination switching unit 12.

Alternatively, the control unit 20 of the image forming apparatus sets the general print mode (first image process mode) in response to the reception of the print data via the communication unit 25 to control the operation of the image forming unit using the paper carriage via the first route by the carriage mechanism 18 and execute the general print processing (first image forming process). That is, the communication unit 25 of the image forming apparatus receives the print data, the image forming unit forms the image on the paper 8 based on the print data and carries the paper 30 on which the image is formed to the paper discharging tray (discharge destination) 14 via the paper discharging destination switching unit 12.

Alternatively, the control unit 20 of the image forming apparatus sets an image-quality adjustment print mode (second image process mode) in response to the execution command of the image-quality adjustment mode to control the operation of the image forming unit using the paper carriage via the second route and execute the image-quality adjustment print processing (second image forming process). That is, the image forming unit of the image forming apparatus forms the test image on the paper 8 based on the test print data stored in the data storage unit 26 and the image sensor 11 reads the test image from the paper 30 and carries the paper 30 on which the image is formed to the pre-erasing paper cassette 16' via the paper discharging destination switching unit 12 and the carriage destination cassette switching unit 15'.

Thereafter, the control unit 20 of the image forming apparatus controls the operation of the image forming unit (fixing unit 10') using the paper carriage via the third route and executes the erasing process, at an appropriate timing. That is, the fixing unit 10' of the image forming apparatus heats the paper 30 at the temperature value for erasing the image and erases the test image from the paper 30 and carries paper 34 from which the image is erased to the paper-feeding cassette 7 as the re-accommodation destination.

As described above, the control unit 20 of the image forming apparatus sets an image-quality adjustment print mode (second image process mode) in response to the execution command of the image-quality adjustment mode to control the execution of the paper carriage via the second route. That is, the paper 30 on which the test image is printed is once accommodated in the pre-erasing paper cassette 16'. Thereafter, the control unit 20 controls the execution of the paper carriage via the third route at an appropriate timing. Thereby, the paper 8 is carried to the fixing unit 10' and the fixing unit 10' erases the image from the paper 30. Thereafter, the paper 34 is carried to the paper-feeding cassette 7 and the paper-feeding cassette 7 accommodates the paper 8.

For example, the control unit 20 of the image forming apparatus controls the execution of the paper carriage via the third route when a standby state (non-operation state) is continued for a predetermined period (non-execution period of the first image forming process elapses a predetermined time). Alternatively, the control unit 20 of the image forming apparatus controls the execution of the paper carriage via the third route at a specified time. In this case, the control unit 20 controls the fixing unit 10' at a high temperature for erasing without performing the image forming process based on the image data. Thereby, the image is erased from the paper 30 that passes through the fixing unit 10'. The paper 30 from which the image is erased is carried to the paper-feeding cassette 7 via the paper discharging destination switching unit 12 and the carriage destination cassette switching unit 15'.

By the above configuration, since the image forming apparatus does not have to include the recording material eraser 9, the image forming apparatus may be implemented at low cost.

Further, although the first to third embodiments describe the automatic image-quality adjustment in the image forming apparatus using the toner as the erasable recording material, the same automatic image-quality adjustment may be performed even in the image forming apparatus in an inkjet manner.

According to the above-mentioned at least one embodiment, the image forming apparatus may automatically perform the image quality correction processing (gradation correction processing) with high accuracy at an appropriate timing, without the user performing the printing command of the correction pattern and the working for the scanner operation for the image forming apparatus. In addition, since the image forming apparatus may automatically return the paper used to print the test pattern to the paper-feeding cassette 7, the waste of paper may be prevented.

Hereinafter, the configuration of the image forming apparatus according to the first to third embodiments is summarized.

(1) The image forming apparatus forming the image using the erasable recording material includes the following.

(a) The pattern printing function for gradation correction (b) The pattern reading function for gradation correction using a line sensor disposed under the fixing unit (c) The calculator calculating the parameter for gradation correction from the reading value of the read correction pattern (d) The image process unit performing the gradation correction using the parameter for gradation correction (e) The switching function of the output destination of the paper read by the line sensor to the paper discharging tray or the eraser (f) The eraser erasing the recording material by heating the recording material (g) The path returning the paper from which the recording material is erased by the eraser to the cassette (2) The image forming apparatus forming the image using the erasable recording material includes the following.

(a) The printing function of the pattern for color conversion correction including a patch in which the recording materials having a plurality of colors overlaps (b) The reading function of the pattern for color conversion correction using the line sensor disposed under the fixing unit (c) The calculator calculating the parameter for color conversion correction from the reading value of the pattern for read color conversion correction (d) The image process unit performing the color conversion correction using the parameter for color conversion correction (e) The switching function of the output destination of the paper read by the line sensor to the paper discharging tray or the eraser (f) The eraser erasing the recording material by heating the recording material (g) The path returning the paper from which the recording material is erased by the eraser to the cassette (3) The image forming apparatus forming the image using the erasable recording material includes the following.

(a) The pattern printing function for gradation correction (b) The pattern reading function for gradation correction using a line sensor disposed under the fixing unit (c) The calculator calculating the parameter for gradation correction from the reading value of the read correction pattern (d) The image process unit performing the gradation correction using the parameter for gradation correction (e) The switching function of the output destination of the paper read by the line sensor to the paper discharging tray or the eraser (f) The eraser erasing the recording material by heating the recording material (g) The determiner determining whether the paper from which the recording material is erased by the eraser is usable (h) The path returning the paper determined to be reusable by the determiner to the cassette (g) The path carrying the paper to the discarded cassette storing the paper determined not to be reusable by the determiner (4) The image forming apparatus forming the image using the erasable recording material includes the following.

(a) The pattern printing function for gradation correction (b) The pattern reading function for gradation correction by a line sensor disposed under the fixing unit (c) The calculator calculating the parameter for gradation correction from the reading value of the read correction pattern (d) The image process unit performing the gradation correction using the parameter for gradation correction (e) The pre-erasing paper cassette storing the pre-erasing paper read by the line sensor (f) The switching function of the output destination of the paper read by the line sensor to the paper discharging tray or the pre-erasing paper cassette (g) The carriage function performing the paper feeding from the pre-erasing paper cassette and carrying the pre-erasing paper to the fixing unit without performing the printing for the pre-erasing paper (h) The fixing unit having the erasing mode erasing the recording material (i) The carriage path carrying the paper from which the recording material is erased by the fixing unit up to the cassette While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an accommodation unit that accommodates a recording medium;

an image forming unit that forms an image on the recording medium;

an image reading unit that reads the image from the recording medium on which the image is formed;

an image erasing unit that erases the image from the recording medium on which the image is formed;

a first medium processing unit that carries the recording medium to the image forming unit from the accommodation unit, executes a first image forming process on the recording medium by the image forming unit, and carries the recording medium on which the image is formed to the discharging destination from the image forming unit, based on the setting of the first image process mode; and a second medium processing unit that carries the recording medium to the image forming unit from the accommodation unit, executes a second image forming process on the recording medium by the image forming unit, carries the recording medium on which the image is formed to the image reading unit from the image forming unit, reads the image from the recording medium on which the image is formed by the image reading unit, carries the recording medium on which the image is formed to the image erasing unit from the image reading unit, erases the image from the recording medium on which the image is formed by the image erasing unit, and carries the recording medium from which the image is erased to the re-accommodation destination from the image erasing unit, based on the setting of the second image process mode.

2. The apparatus of claim 1, wherein the second medium processing unit carries the recording medium from which the image is erased to the accommodation unit as the re-accommodation destination from the image erasing unit based on the setting of the second image process mode.

3. The apparatus of claim 1, wherein the first medium processing unit executes the first image forming process based on the image data designated by a user, based on the setting of the first image process mode.

4. The apparatus of claim 1, wherein the second medium processing unit executes the second image forming process based on the image data for test, based on the setting of the second image process mode.

5. The apparatus of claim 1, wherein the image forming unit adjusts the image quality based on the image reading results.

6. The apparatus of claim 1, wherein the image forming unit corrects gradation processing parameter based on the image reading results.

7. The apparatus of claim 1, wherein the first medium processing unit sets the first image process mode based on the image formation command from the user.

8. The apparatus of claim 1, wherein the second medium processing unit sets the second image process mode based on the change in temperature.

9. The apparatus of claim 1, wherein the second medium processing unit sets the second image process mode based on the number of execution of the first image forming process.

10. The apparatus of claim 1, wherein the image forming unit forms the image on the recording medium by the erasable recording material.

11. An image forming apparatus, comprising:

a first accommodation unit that accommodates a recording medium;

a second accommodation unit that re-accommodates the recording medium determined not to be reusable;

an image forming unit that forms an image on the recording medium;

an image reading unit that reads the image from the recording medium on which the image is formed;

an image erasing unit that erases the image from the recording medium on which the image is formed;

a first medium processing unit that carries the recording medium to the image forming unit from the first accommodation unit, executes a first image forming process on the recording medium by the image forming unit, and carries the recording medium on which the image is formed to the discharging destination from the image forming unit, based on the setting of the first image process mode;

a second medium processing unit that carries the recording medium to the image forming unit from the first accommodation unit, executes a second image forming process on the recording medium by the image forming unit, carries the recording medium on which the image is formed to the image reading unit from the image forming unit, reads the image from the recording medium on which the image is formed by the image reading unit, carries the recording medium on which the image is formed to the image erasing unit from the image reading unit, erases the image from the recording medium on which the image is formed by the image erasing unit, and carries the recording medium from which the image is erased by the image erasing unit to a sorting unit determining that the recording medium is reusable, and carries the recording medium from which the image is erased to the first accommodation unit from the sorting unit according to the determination that the recording medium from which the image is erased by the sorting unit is reusable, based on the setting of the second image process mode; and a third medium processing unit that carries the recording medium to the image forming unit from the first accommodation unit, executes a second image forming process on the recording medium by the image forming unit, carries the recording medium on which the image is formed to the image reading unit from the image forming unit, reads the image from the recording medium on which the image is formed by the image reading unit, and carries the recording medium on which the image is formed to the image erasing unit from the image reading unit, erases the image from the recording medium on which the image is formed by the image erasing unit, and carries the recording medium from which the image is erased by the image erasing unit to the sorting unit determining that the recording medium is reusable, and carries the recording medium on which the image is formed to the second accommodation unit from the sorting unit according to the determination that the recording medium from which the image is erased by the sorting unit is not reusable, based on the setting of the second image process mode.

12. The apparatus of claim 11, wherein the image forming unit adjusts the image quality based on the image reading results.

13. The apparatus of claim 11, wherein the image forming unit corrects gradation processing parameter based on the image reading results.

14. The apparatus of claim 11, wherein the image forming unit forms the image on the recording medium by the erasable recording material.

15. An image forming apparatus, comprising:

a first accommodation unit that accommodates a recording medium;

a second accommodation unit that re-accommodates the recording medium for reuse;

an image forming unit that forms an image on the recording medium;

a heating unit that heats the recording medium on which the image is formed;

an image reading unit that reads the image from the recording medium on which the image is formed;

a first medium processing unit that carries the recording medium to the image forming unit from the first accommodation unit, executes a first image forming process on the recording medium by the image forming unit, carries the recording medium on which the image is formed to the heating unit from the image forming unit, and heats the recording medium on which the image is formed by the heating unit at a first temperature, and carries the recording medium on which the image is formed to the discharging destination from the image forming unit, based on the setting of the first image process mode; and a second medium processing unit that carries the recording medium to the image forming unit from the first accommodation unit, executes a second image forming process on the recording medium by the image forming unit, carries the recording medium on which the image is formed to the heating unit from the image forming unit, heats the recording medium on which the image is formed at a first temperature by the heating unit, carries the recording medium on which the image is formed to the image reading unit from the image forming unit, reads the image from the recording medium on which the image is formed by the image reading unit, carries the recording medium on which the image is formed to the second accommodation unit from the image reading unit, accommodates the recording medium on which the image is formed by the second accommodation unit, carries the recording medium on which the image is formed to the heating unit from the second accommodation unit, heats the recording medium on which the image is formed at a second temperature by the heating unit to erase the image from the recording medium on which the image is formed, and carries the recording medium from which the image is erased to the first accommodation unit from the image forming unit, based on the setting of the second image process mode.

16. The apparatus of claim 15, wherein the second medium processing unit carries the recording medium on which the image is formed to the heating unit from the second accommodation unit at a specific time, heats the recording medium on which the image is formed at a second temperature by the heating unit to erase the image from the recording medium on which the image is formed, and carries the recording medium from which the image is erased to the first accommodation unit from the image forming unit.

17. The apparatus of claim 15, wherein the second medium processing unit carries the recording medium on which the image is formed to the heating unit from the second receiving unit, heats the recording medium on which the image is formed by the heating unit at a second temperature to erase the image from the recording medium on which the image is formed, and carries the recording medium from which the image is erased to the first accommodation unit from the image forming unit when the non-execution period of the first image forming processing elapses a predetermined time.

18. The apparatus of claim 15, wherein the image forming unit adjusts the image quality based on the image reading results.

19. The apparatus of claim 15, wherein the image forming unit corrects gradation processing parameter based on the image reading results.

20. The apparatus of claim 15, wherein the image forming unit forms the image on the recording medium by the erasable recording material by the heating treatment at the second temperature.

* * * * *